United States Patent [19]

Bautista et al.

[11] Patent Number: 4,494,430

[45] Date of Patent: Jan. 22, 1985

[54] PAPER GUIDE FOR PAPER CUTTER

[75] Inventors: John Bautista, Chicago Ridge; Lawrence H. Miller, Downers Grove Township, Du Page County, both of Ill.

[73] Assignee: Ideal School Supply Corporation, Oak Lawn, Ill.

[21] Appl. No.: 475,000

[22] Filed: Mar. 14, 1983

[51] Int. Cl.[3] ..... B26D 13/4

[52] U.S. Cl. ..... 83/468; 83/607; 144/253 R; 269/303; 269/315

[58] Field of Search ..... 144/253 R, 253 A, 253 B; 83/467, 467 A, 468, 605, 607, 608, 609; 269/303, 315; 493/372

[56] References Cited

U.S. PATENT DOCUMENTS

| | | | |
|---|---|---|---|
| 1,583,964 | 5/1926 | Driggers | 269/315 |
| 2,460,205 | 1/1949 | Webster | 83/468 |
| 2,485,274 | 10/1949 | Garrett | 83/468 |
| 2,591,472 | 4/1952 | Segal | 83/607 |
| 4,182,182 | 1/1980 | Hirsch | 83/467 R |

*Primary Examiner*—W. D. Bray

[57] ABSTRACT

A paper guide mechanism is slidably secured to the ruler of a paper cutter apparatus such that the paper guide mechanism can be rotated from a contact position with the cutting board without disconnecting it from the ruler.

5 Claims, 3 Drawing Figures

PAPER GUIDE FOR PAPER CUTTER

BACKGROUND OF THE INVENTION

Paper cutters consisting of a board surface, ruler and an edge-positioned cutting member typically employ a paper guide mechanism which is attached to the ruler and maintained in contact with the cutting board surface. The paper guide means is movable in a horizontal direction along the ruler and is secured at a preselected ruler location via a thumbscrew. The paper guide provides an edge against which the paper to be cut is positioned relative to the cutting mechanism positioned at the edge of the cutting board. In the event the conventional paper guide mechanism is not required, the paper guide mechanism must be physically removed from the paper cutter. This is an inconvenient procedure and can result in the paper guide mechanism being misplaced insofar as it is physically removed from the paper cutter.

SUMMARY OF THE INVENTION

There is disclosed herein with reference to the accompanying drawings an improved paper guide mechanism which is integrally coupled to the ruler so as to provide not only the conventional horizontal movement of the paper guide mechanism with respect to the cutting board surface but vertical pivotal movement which permits the paper guide mechanism to be removed from contact with the cutting board surface without removing it from its mechanical coupling to the ruler. The novel paper guide design assures the constant availability of the paper guide mechanism while providing increased ease in disengaging the paper guide mechanism from contact with the cutting board surface.

A further improvement is realized through the elimination of the thumbscrew securing device of the prior art paper guide mechanism. A unique interlocking design is provided between the paper guide mechanism and the ruler. The paper guide mechanism has a slight toed-in contour to match a slight undercut bevel at the front edge of the ruler. When the paper guide mechanism is positioned at the appropriate paper width dimension on the ruler, the paper guide mechanism is rotated vertically down over the front edge of the ruler until the front edge of the paper guide mechanism snaps into position against the front edge of the ruler and the cutting board face. This interference fit creates a firm lock that will prevent the paper guide mechanism for moving as the paper stock is positioned against the paper guide mechanism for cutting. A suitable commercially available plastic or rubber can be employed to form the single piece paper guide mechanism and the ruler.

DESCRIPTION OF THE DRAWINGS

The invention will become more readily apparent from the following exemplary description in connection with the accompanying drawings.

DESCRIPTION OF THE PREFERRED EMBODIMENT

Figure 1:
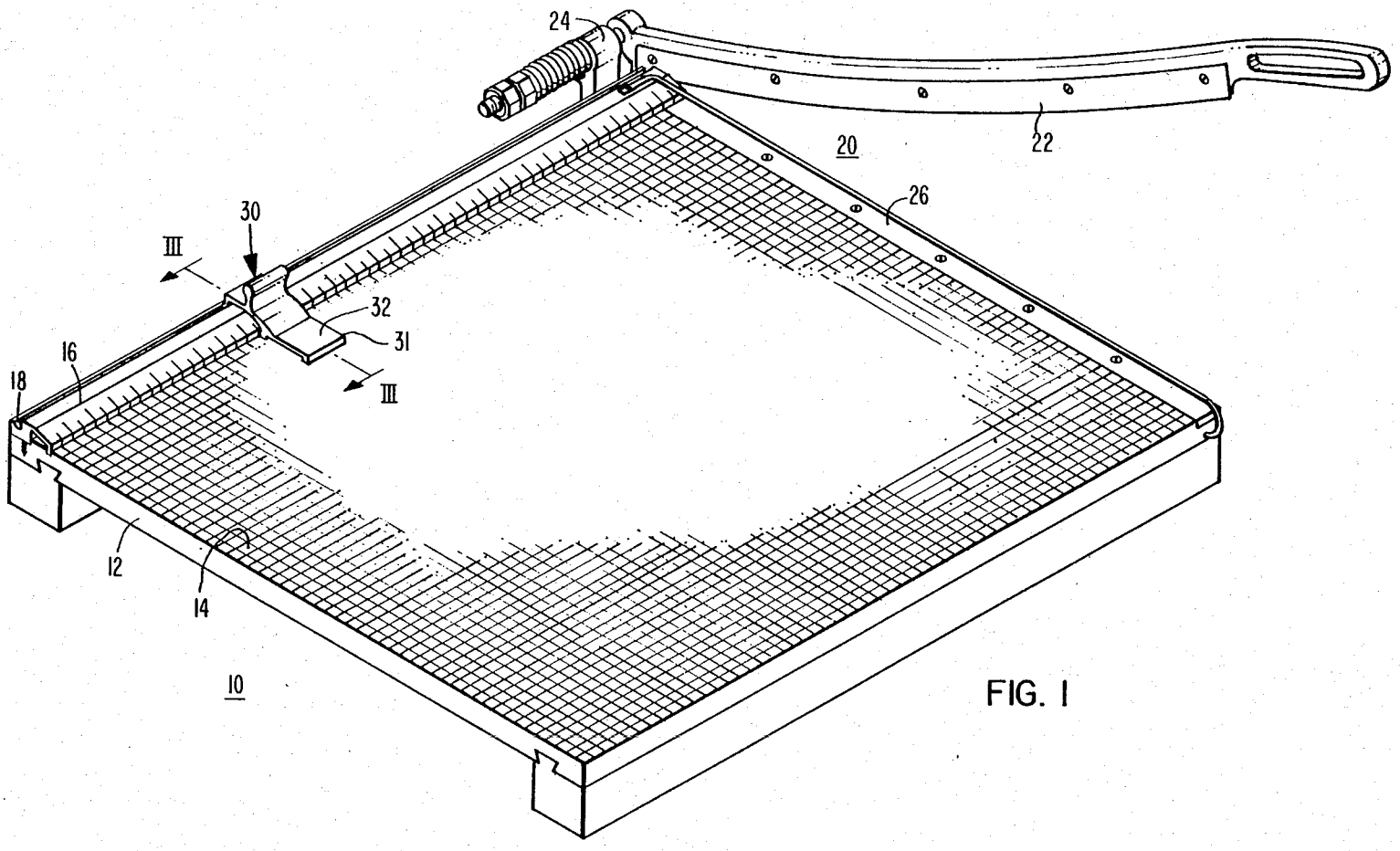
FIG. 1 is a pictorial illustration of a conventional paper cutter apparatus employing the novel paper guide mechanism.

Referring to FIG. 1, there is illustrated a paper cutter apparatus 10 including a cutting board 12 having a cutting board surface 14, a ruler 16 and an edge positioned cutting mechanism 20. The paper cutting mechanism 20 includes a cutting member 22 which is vertically pivoted via pivoting mechanism 24 with respect to a metal cutting edge element 26 which is secured to an edge of the cutting board 12. The vertical movement of the cutting member 22 may be implemented manually or through an electrical motor driven arrangement.

A paper guide 30 is integrally associated with the ruler 16 to provide a paper guide arm 32 having a contact edge 31 against which paper stock is positioned prior to cutting by the vertical paper cutting mechanism 20. The positioning of the paper guide 30 with respect to the ruler 16 establishes the width of the paper stock following cutting. The paper guide 30 is integrally coupled to the ruler 16 by positioning the guide 30 in a horizontal track 18 extending the useful length of the ruler 16 and accommodating horizontal positioning of the paper guide 30 relative to the ruler 16 and the cutting board surface 14.

Figure 2:
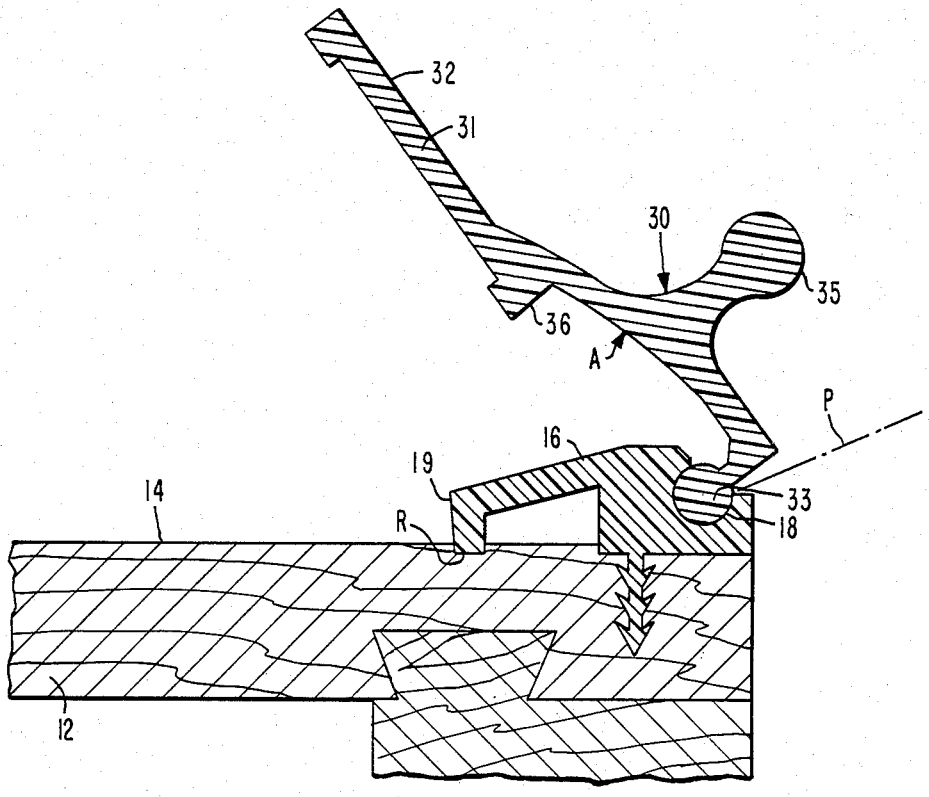
FIG. 2 is a schematic illustration of the paper guide mechanism removed from contact with the cutting board of FIG. 1.
Figure 3:
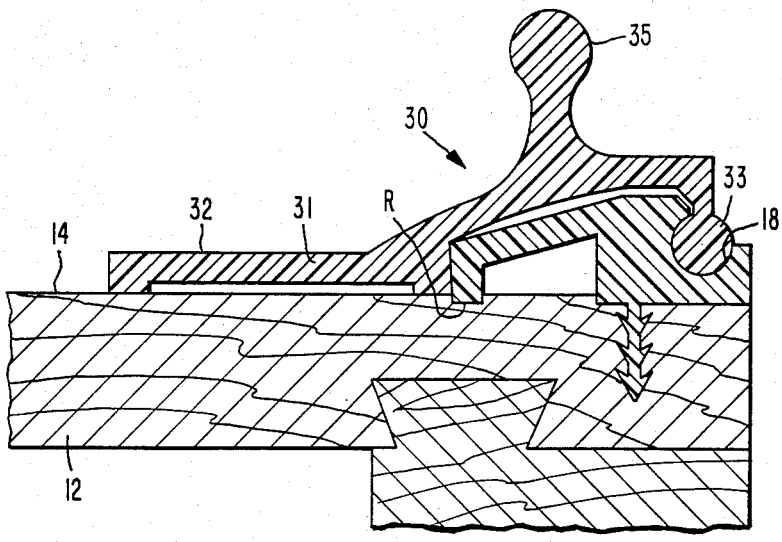
FIG. 3 is a schematic illustration of the paper guide mechanism in contact with the cutting board of FIG. 1.

Referring to FIGS. 2 and 3, there is schematically illustrated in detail the integral, structural and operational relationship between the paper guide 30 and the ruler 16. The paper guide 30, which may be a one piece extruded plastic member, further includes a cylindrical element 33 which is slidably inserted into the cylindrical track 18 of the ruler 16 from either end of the ruler 16. With the paper guide arm 32 in a raised position as shown in FIG. 2, the cylindrical element 33 in combination with the cylindrical track 18 permits horizontal movement of the paper guide 30 along the length of the ruler 16. The combination of the cylindrical element 33 and track 18 further permits vertical, arcuate, rotation of the paper guide arm 32 about the cylindrical member 33 with respect to the ruler 16 and the cutting board surface 14 as illustrated in FIG. 2. Thus, an operator can rotate the paper guide 30 via the handle member 35 to a rest position P thereby physically removing the paper guide arm 32 from the cutting board surface 14 when the paper guide 30 is not in use. The interference, or friction, fit between the track 18 and the cylindrical element 33 maintains the guide 30 in a raised position when it is not in use.

The ruler 16, which may also be of plastic material, is secured in a recessed position R in the cutting board 12 to prevent paper from sliding beneath the ruler 16.

In the event the paper guide 30 is to be employed to provide a reference edge at a prescribed position on the ruler 16 for paper stock, the paper guide 30 is horizontally moved to a preselected ruler position. The paper guide 30 is then rotated into a locking engagement with the ruler 16 as illustrated in FIG. 3 with the paper guide arm 32 contacting the surface 14 of the cutting board 12.

While the prior art paper guide devices require mechanical securing means, such as a thumbscrew, to lock the paper guide at a prescribed position with respect to the ruler, the design of the engaging edges 36 and 19 of the paper guide 30 and ruler 16 respectively provides a snap action locking engagement when the paper guide arm 32 is rotated into a contact position with the cutting board surface 14 as illustrated in FIG. 3. The slightly toed-in contour of the mating edge 36 of the paper guide 30 is designed to engage the slight undercut bevel edge 19 of the ruler 16 in an interference fit.

When the paper guide 30 is brought into contact with the ruler 16 and manual pressure is applied to the handle member 35, the arch A between the engaging edge 36 and the cylindrical member 33 flattens out, which opens the guide 30 to receive the ruler 16.

The resiliency of the plastic or rubber material of the guide 30 is such that the mating edge portion of the guide is "stretched" over the ruler 16 and the engaging edge 36 is forced over and snaps against the ruler mating edge 19. A clamping effect is produced in that the engaging edge 36 and cylindrical member 33 of the guide 30 embrace the ruler 16 via the track 18 and mating edge 19 as shown in FIG. 3.

Pressure exerted anywhere along the paper guide edge 31 by the paper stock being positioned for cutting translates a wedge force across points 18 and 19 that will further prevent the guide 30 from moving horizontally in the track 18.

We claim:

1. In a paper cutter apparatus including a cutting board having a surface to accommodate the paper stock to be cut, a graduated ruler to permit selection of the width of the cut paper stock, and a cutting mechanism, the improvement of a paper guide means associated with the ruler to provide a surface against which the paper stock is positioned prior to cutting, the improvement comprising, a ruler affixed to said cutting board and having a cylindrically shaped groove extending at least the useful length thereof, and a paper guide means having a paper guide arm and a cylindrical member, said cylindrical member being slidably positioned within the cylindrically shaped groove of said ruler to enable said paper guide means to horizontally traverse the cutting board surface and to vertically rotate about said cylindrical member from a position wherein said paper guide arm contacts said surface to a position removed from said cutting board surface.

2. In a paper cutter apparatus including a cutting board having a surface to accommodate the paper stock to be cut, a graduated ruler to permit selection of the width of the cut paper stock, and a cutting mechanism, the improvement of a paper guide means associated with the ruler to provide a surface against which the paper stock is positioned prior to cutting, the improvement comprising:

a ruler affixed to said cutting board and having a cylindrically shaped groove extending at least the useful length thereof, and a paper guide means having a paper guide arm and a cylindrical member, said cylindrical member being slidably positioned within the cylindrically shaped groove of said ruler to enable said paper guide means to horizontally traverse the cutting board surface and to vertically rotate about said cylindrical member from a position wherein said paper guide arm contacts said cutting board surface to a position removed from said surface, said paper guide means engaging said ruler in an interference fit when said paper guide arm contacts said cutting board surface to essentially secure said paper guide means at a fixed location on said ruler.

3. In a paper cutter apparatus as claimed in claim 2 wherein a toed-in contour of an edge of said paper guide means engages an undercut bevel edge of said ruler to effect snap-lock engagement between said paper guide means and said ruler when said paper guide arm contacts the surface of said cutting board.

4. In a paper cutter apparatus as claimed in claim 2 wherein said paper guide means is an extruded plastic device including a handle member to accommodate manual gripping and positioning of the paper guide means.

5. In a paper cutter apparatus as claimed in claim 1 wherein said ruler is recessed beneath the surface of the cutting board to prevent paper stock from sliding beneath the ruler.

* * * * *